US010000978B2

(12) United States Patent
Angman

(10) Patent No.: US 10,000,978 B2
(45) Date of Patent: Jun. 19, 2018

(54) TUBULAR CENTRALIZER

(71) Applicant: Per Angman, Calgary (CA)

(72) Inventor: Per Angman, Calgary (CA)

( * ) Notice: Subject to any disclaimer, the term of this patent is extended or adjusted under 35 U.S.C. 154(b) by 368 days.

(21) Appl. No.: 14/647,264

(22) PCT Filed: Nov. 29, 2013

(86) PCT No.: PCT/CA2013/050919
§ 371 (c)(1),
(2) Date: May 26, 2015

(87) PCT Pub. No.: WO2014/082183
PCT Pub. Date: Jun. 5, 2014

(65) Prior Publication Data

US 2015/0300100 A1 Oct. 22, 2015

Related U.S. Application Data

(60) Provisional application No. 61/731,393, filed on Nov. 29, 2012.

(51) Int. Cl.
*E21B 17/10* (2006.01)
*E21B 19/16* (2006.01)

(52) U.S. Cl.
CPC ..... *E21B 17/1078* (2013.01); *E21B 17/10* (2013.01); *E21B 19/16* (2013.01)

(58) Field of Classification Search
CPC ..... E21B 17/10; E21B 17/1078; E21B 19/16
See application file for complete search history.

(56) References Cited

U.S. PATENT DOCUMENTS 1,907,825 A * 5/1933 Johnson ..... E21B 17/1078 166/241.6
2,318,878 A * 5/1943 Miller ..... E21B 17/1042 175/325.5
2,860,013 A 11/1958 Medearis
3,088,532 A * 5/1963 Kellner ..... E21B 4/18 166/212

(Continued)

FOREIGN PATENT DOCUMENTS

GB 2385342 8/2003
GB 2385342 A * 8/2003 ..... E21B 17/10

OTHER PUBLICATIONS

CA 2,892,537 Examiner Requisition, May 10, 2016.

*Primary Examiner* — Matthew R Buck
(74) *Attorney, Agent, or Firm* — Parlee McLaws LLP (CGY); Linda Thompson; Sean Goodwin

(57) ABSTRACT

A centralizer is provided for centralizing a tubular, such as a drill pipe, in a wellbore. The centralizer comprises a resilient inner sleeve comprising three or more protruding members extending radially outwardly from an outer surface of the inner sleeve. The inner sleeve receives the tubular and spaces the tubular from the wellbore. The centralizer further comprises an outer support body for receiving the outer surface of inner sleeve. When the inner sleeve is retained between the support body and the tubular, the protruding members project out through windows formed in the support body. The support body and the inner sleeve are retained about the tubular with a pair of annular end collars. A method for replacing worn components of the centralizer is also provided.

15 Claims, 13 Drawing Sheets

(56) References Cited

U.S. PATENT DOCUMENTS

| | | | | | |
|---|---|---|---|---|---|
| 4,059,164 | A | | 11/1977 | Farris | |
| 4,549,613 | A | * | 10/1985 | Case | E21B 10/26 175/325.2 |
| 5,174,679 | A | * | 12/1992 | Wolf | E21B 17/105 166/241.1 |
| 5,692,563 | A | | 12/1997 | Kruger | |
| 5,803,193 | A | * | 9/1998 | Krueger | E21B 17/1007 166/241.6 |
| 5,833,018 | A | * | 11/1998 | von Gynz-Rekowski | E21B 17/1064 166/241.4 |
| 6,152,220 | A | * | 11/2000 | Carmichael | E21B 17/1078 166/173 |
| 6,453,999 | B1 | | 9/2002 | Reinholdt | |
| 6,484,803 | B1 | | 11/2002 | Gremillion | |
| 6,830,102 | B2 | | 12/2004 | Kirk | |
| 7,096,940 | B2 | * | 8/2006 | Baxter | E21B 17/1085 166/241.6 |
| 7,409,758 | B2 | | 8/2008 | Le | |
| 7,493,949 | B2 | * | 2/2009 | Baird | E21B 10/26 166/173 |
| 7,810,573 | B2 | * | 10/2010 | Baird | E21B 10/26 166/242.1 |
| 7,942,199 | B2 | | 5/2011 | Angman | |
| 8,167,034 | B2 | * | 5/2012 | Castro | E21B 17/1078 166/241.6 |
| 8,511,377 | B2 | * | 8/2013 | Casassa | E21B 17/1042 166/241.6 |
| 2005/0241822 | A1 | | 11/2005 | Gremillion | |
| 2006/0231250 | A1 | * | 10/2006 | Slack | B21D 17/00 166/241.6 |
| 2008/0164019 | A1 | | 7/2008 | Angman | |

* cited by examiner

TUBULAR CENTRALIZER

FIELD

Embodiments disclosed herein relate to apparatus for centralizing a tubular in a wellbore and more particularly, to centralizing a tubular drill string in a wellbore. Embodiments disclosed herein also relate to a method for replacing worn components/parts of the apparatus.

BACKGROUND

Centralizers are known for positioning tubulars, such as casing, drill pipes, rod strings and the like, within wellbores to minimize wear between the tubular and the wellbore walls, in the case of an openhole application or from the casing walls in a cased wellbore, regardless the orientation of the wellbore. Without a centralizer, wear may be enhanced in horizontal wellbores particularly at the heel of the wellbore where directional changes would otherwise cause the tubular to engage the casing. Further, without a centralizer, grinding of the casing may occur when portions of the tubular, such as the drill pipe tool joints, are hardfaced with abrasive material such as tungsten carbide. Efforts are made to make the hardfacing as smooth as possible so as to minimize the casing wear but since the drill pipe rotates it is inevitable that drill pipe tool joints will wear against the casing.

Generally, the centralizer engages the tubular and acts to space the tubular from either the wellbore walls or from the casing. Casing centralizers are generally one piece and slide over the casing. Tubulars, such as drill pipe, have tool ends formed thereon and therefore drill pipe centralizers must be clamped over the tubular and secured thereon.

One such centralizer available from Hawkeye Industries Inc. of Edmonton, Alberta, Canada comprises a discontinuous, molded urethane, tubular body which is sufficiently flexible to be installed about a tubing string. The tubular body has molded fins extending therefrom to space the tubing string from the casing or wellbore walls. The centralizer is secured about the tubing string using a stainless steel band clamp. When the fins on the centralizer body have worn such that they no longer provide sufficient offset to space the tubular from the wellbore or casing walls, the centralizers are discarded and replaced.

Another tubing centralizer is available from Western Well Tool Ltd., of Houston Tex., USA. A tubular body of the centralizer comprises a plurality of hinged segments which are pinned together to encircle the tubular. Opposing end collars abut uphole and downhole ends of the tubular body for positioning the centralizer along a length of the tubular. The end or thrust collars, generally comprise two arcuate segments which are bolted together about the tubular to form the thrust collars. The thrust collars sandwich the tubular body therebetween in the axial direction. The bolts are typically high tensile steel bolts. Applicant understands that the hinged segments and the pins which connect the segments to form the body are prone to failure with repeated use. Failure of centralizers can be costly, particularly if portions of the centralizer fall into the wellbore and disrupt operations therein.

Yet another example of a prior art tubing centralizer is the RotoTECO centralizer available from Tercel Oilfield Products, Dubai, UAE. The RotorTEC® comprises a freely rotating outer sleeve positioned over an internal pipe sleeve. The sleeves are made of a composite material such as a self-lubricating polymer with a low coefficient of friction and appear to comprise at least two "clam-shell" halves which are pinned together in order to be positioned over the tubing. Upper and lower retaining clamps are bolted about the tubing string for retaining the sleeves thereon in the axial direction. When the outer sleeve is worn such that it no longer provides sufficient standoff to space the tubular from the wellbore or casing walls, at least the outer sleeve must be discarded and replaced.

There is interest in the industry for a simple, efficient tubing centralizer which can be robustly secured to the tubing string and which reduces the cost associated with replacement thereof.

SUMMARY

Embodiments disclosed herein are related to tubing centralizers and, more particularly, to drill pipe centralizers. The term tubular is used herein in a broad sense to mean a tubular, drill pipe, tubular strings, a casing or the like. The tubular centralizers have a simple construction and have reduced number of connectors thereby minimizing the risk of failure and setup/assembly time. The structure of the tubular centralizer is also such that it enables replacement of only the component contacting the wellbore or casing walls and deteriorated due to constant contact. End collars of the centralizer retain other components of the centralizer both radially and axially about the tubular.

Accordingly in one broad aspect there is provided a centralizer for installing about a joint of tubular within a wellbore. The centralizer comprises a resilient inner sleeve having a central bore formed therethrough for receiving the tubular therein and an outer surface from which three or more protruding members extend radially outwardly. The three or more protruding members are spaced circumferentially about the inner sleeve for spacing the tubular from the wellbore. The centralizer further comprises a tubular outer support body having opposing end portions and a central bore formed therethrough for receiving the inner sleeve's outer surface. The support body has windows formed therein which correspond with the protruding members. When the inner sleeve is retained between the support body and the tubular, the protruding members project through the windows with the balance of the inner sleeve extending longitudinally beneath the support body. The centralizer further comprises a pair of annular end collars for retaining the outer body and inner sleeve in the radial direction about the tubular and axially thereto. Each end collar has a collar bore for securing to the tubular and for securing to an opposing end portion of the support body.

Accordingly in another broad aspect a method for removing and replacing worn components of a centralizer is provided. The centralizer comprises two or more arcuate inner sleeve segments retained about the tubular by two or more support body segments. The two or more support body segments are retained both axially and radially about the inner sleeve segments by the end collar. The method comprises disengaging at least one of the pair of end collars and removing at least one of the two or more support body segments for accessing the two or more inner sleeve segments having one or more worn protruding members. At least one inner sleeve segment with the worn protruding members is removed. Each of the removed inner sleeve segments is replaced with a replacement inner sleeve segment with its protruding members extending through corresponding support body windows of the at least one removed support body segment. The method further comprises reinstalling the outer body segments and replacement inner sleeve segments about the tubular and securing the at least one end collar about opposing ends of the support body.

The inner sleeve and the support body may comprise multiple segments.

In one embodiment, the inner sleeve comprises two or more arcuate inner sleeve segments retained about the tubular by the support body.

In another embodiment, the inner sleeve comprises three or more arcuate inner sleeve segments retained about the tubular by the support body.

In another embodiment, the support body comprises two or more support body segments and the two or more support body segments are retained about the inner sleeve by the end collars.

In another embodiment, the inner sleeve comprises two or more arcuate inner sleeve segments and the support body comprises two or more support body segments. The two or more inner sleeve segments are retained about the tubular by the two or more support body segments. The two or more support body segments are retained about the inner sleeve by the end collars.

In another embodiment, the inner sleeve comprises three or more arcuate inner sleeve segments and the support body comprises two or more support body segments. The three or more inner sleeve segments are retained about the tubular by the two of more support body segments. The two or more support body segments are retained about the inner sleeve by the end collars.

In another embodiment, the inner sleeve comprises six arcuate inner sleeve segments spaced at about 60 degrees and the support body comprises two semi-circular support body segments forming six windows. The six inner sleeve segments are retained about the tubular by the two support body segments. The two support body segments are retained about the inner sleeve by the end collars.

BRIEF DESCRIPTION OF DRAWINGS

FIG. 8A shows the tubular supported in the inner sleeve of the centralizer, and FIG. 8B is shown absent the tubular for illustrating the interface of the inner sleeve and support body in the end collar.

DETAILED DESCRIPTION

Figure 1A:
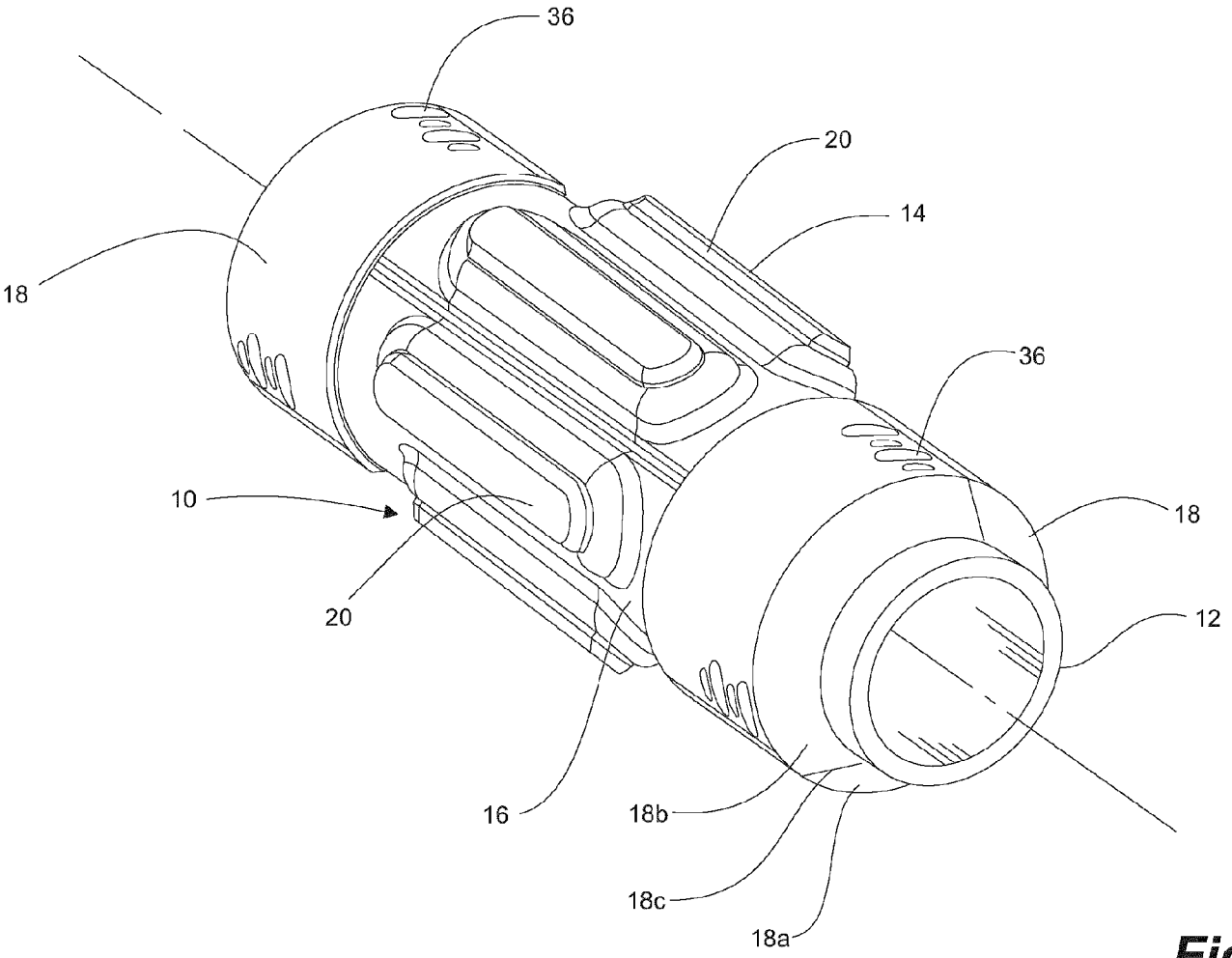
FIG. 1A is a perspective view of a tubular centralizer according to an embodiment disclosed herein and shown installed on a section of tubular.

Referring to FIG. 1A, a centralizer 10 according to one embodiment is shown installed on a section or joint of a tubular 12 such as a drill pipe. The centralizer 10 comprises a resilient inner sleeve 14 for supporting the tubular 12 from the wellbore such as casing or other tubular string. The centralizer 10 further comprises a tubular outer support body 16, sandwiching the inner sleeve 14 between the body 16 and the tubular 12. Despite being fit with an outer support body, the inner sleeve 14 protrudes therethrough so as to engage the wellbore (not shown), centralizing and spacing both the tubular 12 and the support body 16 therefrom. Preferably, the inner sleeve 14 is made of a polymer such as polyurethane for minimizing damage to the wellbore on one side and particularly to the tubular on the other side. The inner sleeve 14 serves as a sacrificial component for periodic replacement.

Figure 1B:
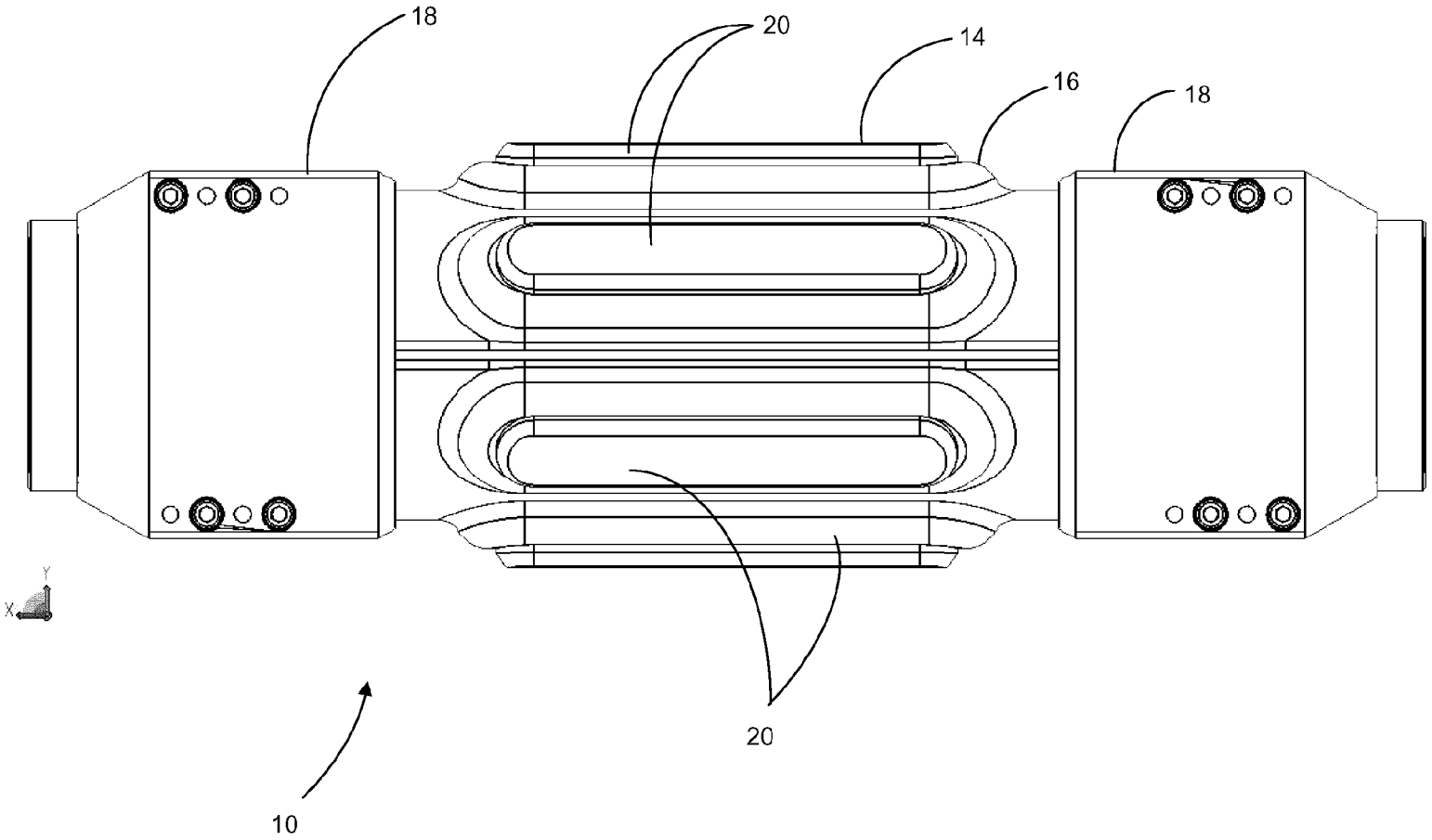
FIG. 1B is a side view of the tubular centralizer according to FIG. 1A.
Figure 1C:
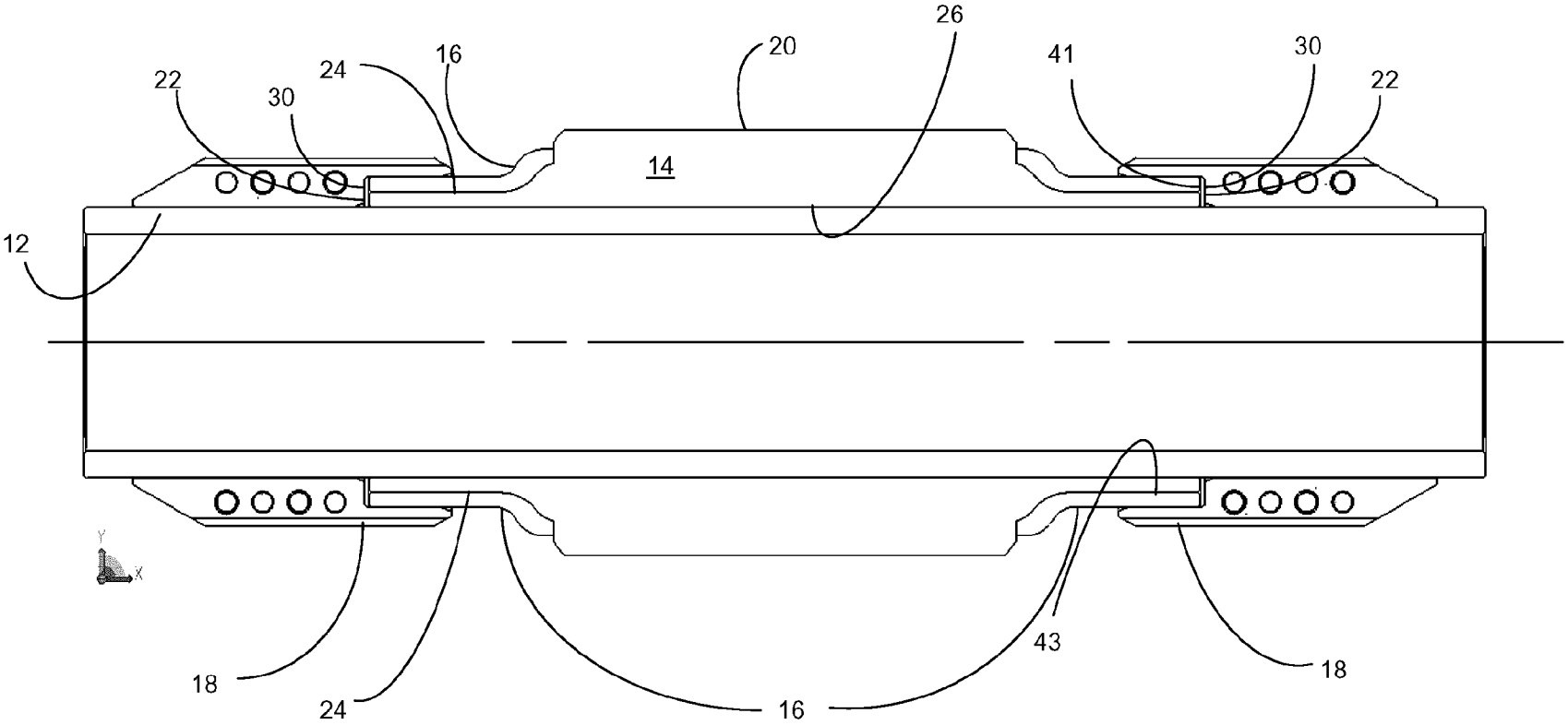
FIG. 1C is a side cross-sectional view of the tubular centralizer according to FIG. 1A.

With reference to FIGS. 1B and 1C, the inner sleeve 14 comprises three or more circumferentially spaced protruding members 20 formed generally longitudinally along the inner sleeve between opposing ends 22, 22 of the inner sleeve 14.

The support body 16 is more robust, generally being manufactured of metal such as steel. Thus, both the tubular 12 and the wellbore side walls are contacted by a softer resilient material and contact with the hard support body 16 is avoided or at least minimized. The support body 16 retains the inner sleeve 14 in the radial direction and circumferentially about the tubular 12. The hard support body 16 further also protects the softer inner sleeve 14. The inner sleeve 14 and the support body 16 are retained both axially along and radially about the tubular 12 using a pair of bookend end collars 18,18. The end collars 18,18, in addition to retaining the inner sleeve 14 and support body 16 on the tubular 12 also axially position the support body 16 and the inner sleeve 14 along the tubular 12.

The disclosed inner sleeve 14 may be of a single piece construction with a split for resilient installation about the tubular, or may comprise multiple segments that cooperate as a circumferential array about the tubular 12. For ease of assembly about the tubular 12, the inner sleeve 14 and the support body 16 are formed of at least two segments. The description and drawings describe and illustrate the inner sleeve 14 and support body 16 as comprising at least two segments, however, it is to be understood that the disclosure is not so limited.

Figure 2A:
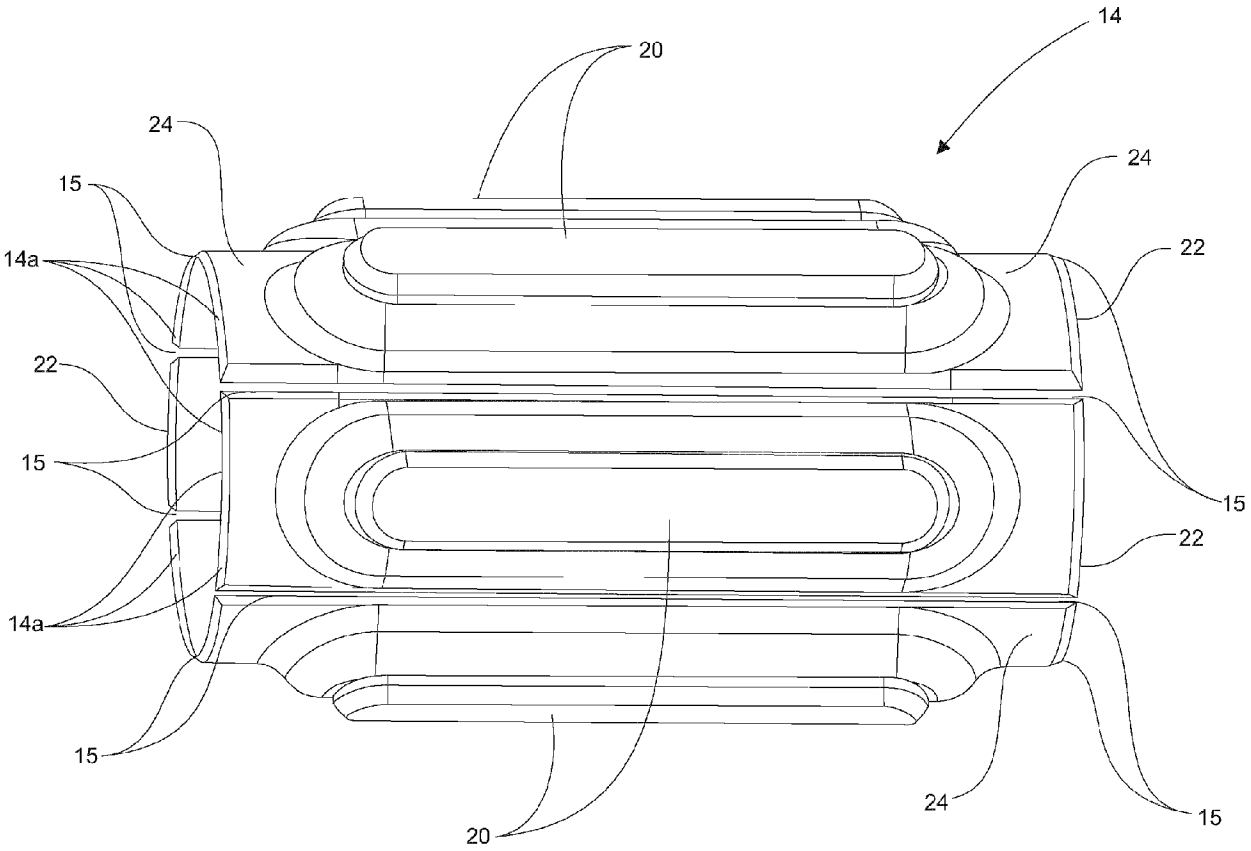
FIG. 2A is a perspective side view of six inner sleeve segments of the centralizer of FIG. 1A, each inner sleeve segment having one protruding member for a total of six when assembled.

With reference to FIG. 2A, an inner sleeve 14 formed of six arcuate inner sleeve segments 14*a* spaced at about 60 degrees is illustrated. Each inner sleeve segment 14*a* comprises at least one of the protruding members 20. The protruding member 20 extends radially outwardly from an outer surface 24 of the inner sleeve segment 14*a*. The multiple inner sleeve segments 14*a* are arranged circumferentially in a radial array about the tubular 12 and abut each other along longitudinal edges 15 to form the inner sleeve 14. The inner sleeve 14 forms a central bore 26. The tubular 12 is longitudinally supported in the central bore 26. The inner sleeve segments 14*a* and the protruding members 20 thereon are configured such that when assembled protruding members 20 are evenly and circumferentially spaced about the inner sleeve 14 and tubular 12.

Figure 2B:
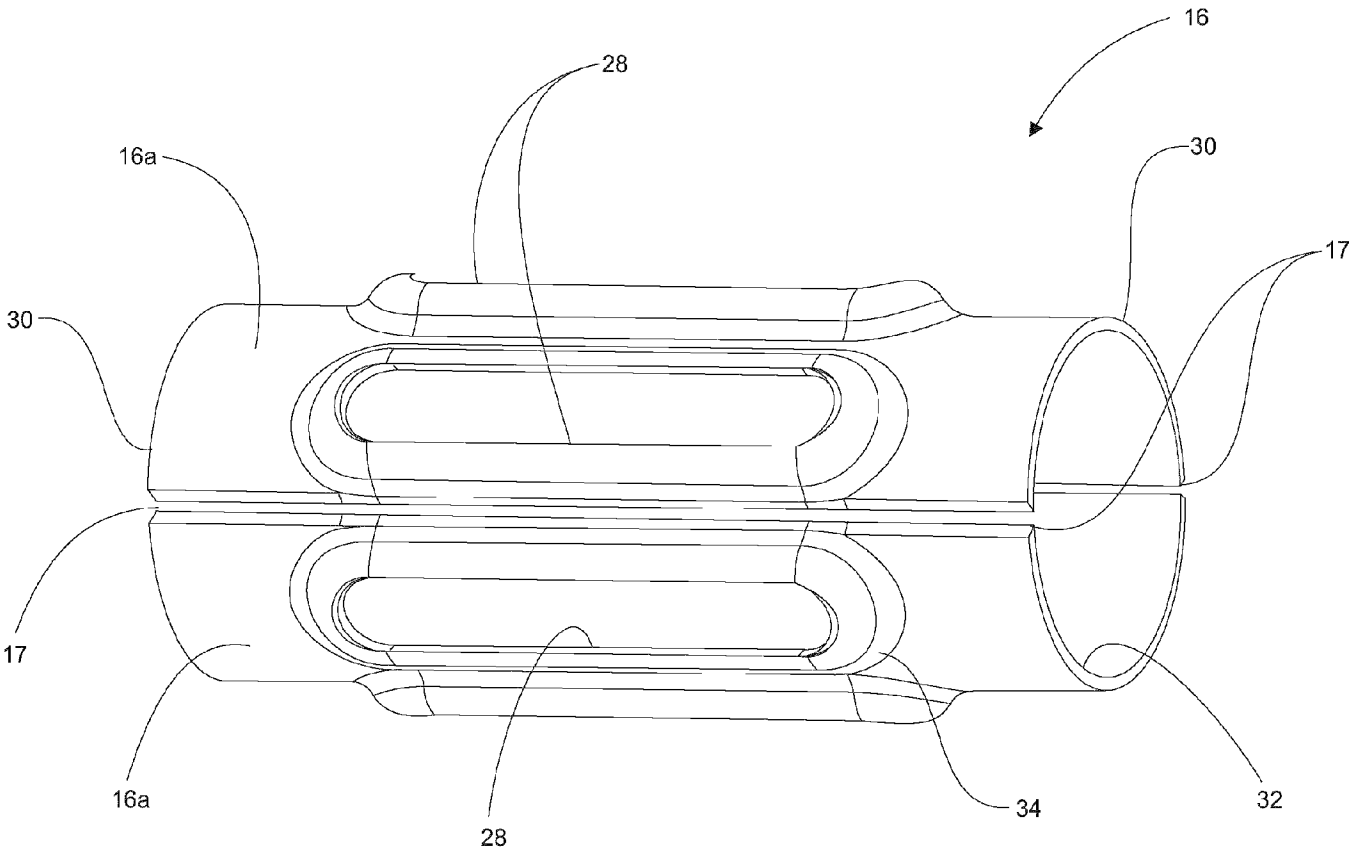
FIG. 2B is a perspective side view of two semi-circular support body segments of the centralizer of FIG. 1A, each support body segment having three windows for receiving the protruding members of three inner sleeve segments when assembled.

FIG. 2B illustrates a support body 16 generally formed of two or more support body segments 16*a* for ease of installation. In one embodiment, the support body 16 is formed of two, semi-circular support body segments 16*a*,16*a*. As shown, each support body segment 16*a* is configured to house three inner sleeve segments 14*a*,14*a*,14*a* of FIG. 2A. Accordingly, each support body segment 16*a* comprises three windows 28 formed generally lengthwise between opposing end portions 30, 30 of the support body 16. When arranged circumferentially, the two support body segments abut each other along longitudinal edges 17 forming a central bore 32. The support body's bore 32 retains the outer surface 24 of the inner sleeve 14. Each window 28 is supported within a longitudinal buttress 34 about a perimeter of the window 28. The support body segments 16*a*, the windows 28 and the buttresses 34 are configured such that when the support body segments 16*a* are arranged circumferentially, the windows 28 and the buttresses 34 are evenly spaced about the support body 16, corresponding to the arrangement of the protruding members 20.

The protruding members 20 and the windows 28 are complementary to each other and align during assembly. The windows 28 are sized and shaped to receive the protruding members 20 during assembly.

Depending upon the number of inner sleeve segments, and protruding members per inner sleeve segment 14*a*, and the number of support body segments 16*a* and corresponding windows 28 formed therein, the inner sleeve segments 14*a* may need to installed into the support body 16 before assembly to the tubular 12 or, in other instances, typically with a large number of segments 14*a*,16*a*, one can assemble the support body segments to inner sleeve segments already arranged about the tubular 12. The resilience of the inner sleeve can aid in manipulating the protruding members 20 through corresponding windows 28.

Figure 2C:
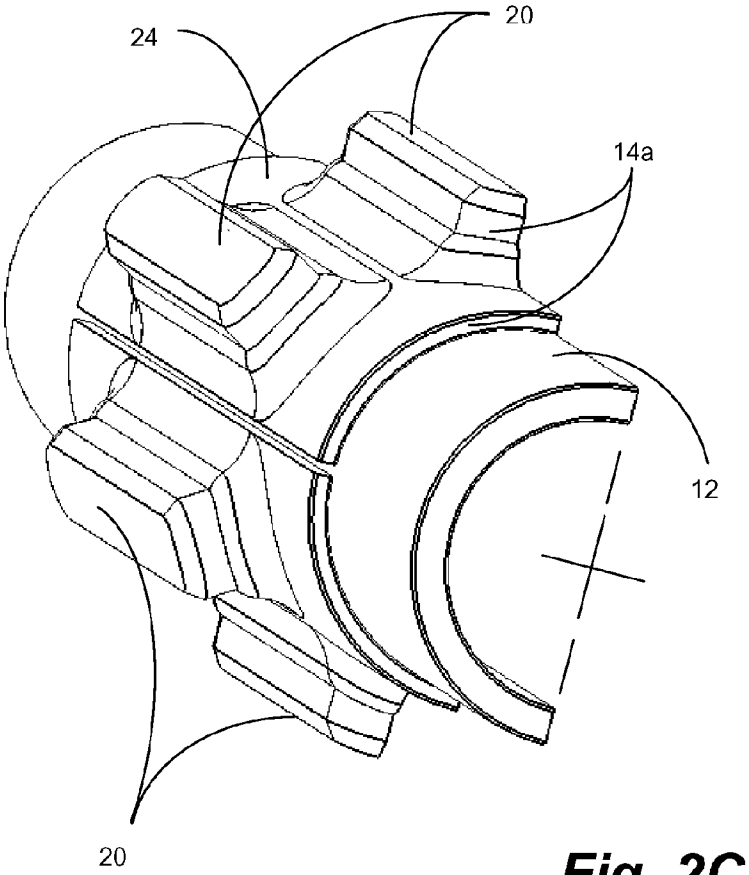
FIG. 2C is a perspective side view of two of four inner sleeve segments arranged on a tubular of the centralizer of FIG. 1A, each inner sleeve segment having one and one-half protruding members for a total of six when assembled.
Figure 2D:
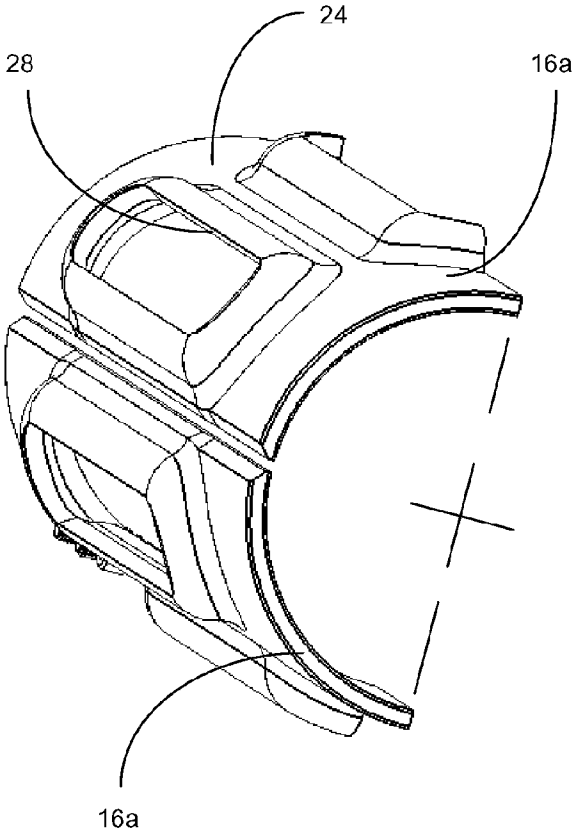
FIG. 2D is a perspective side view of a half section of each of two of semi-circular support body segments of the centralizer of FIG. 1A, each support body having three windows for receiving combined three protruding members from two inner sleeve segments of FIG. 2A.

As shown in FIG. 2C, a tubular 12 is shown fit with two of four inner sleeve segments 14*a*. In FIG. 2D, two quadrants of two support body segments 16*a* are shown in corresponding orientation for installation to the inner sleeve segments 14*a*.

Figure 3A:
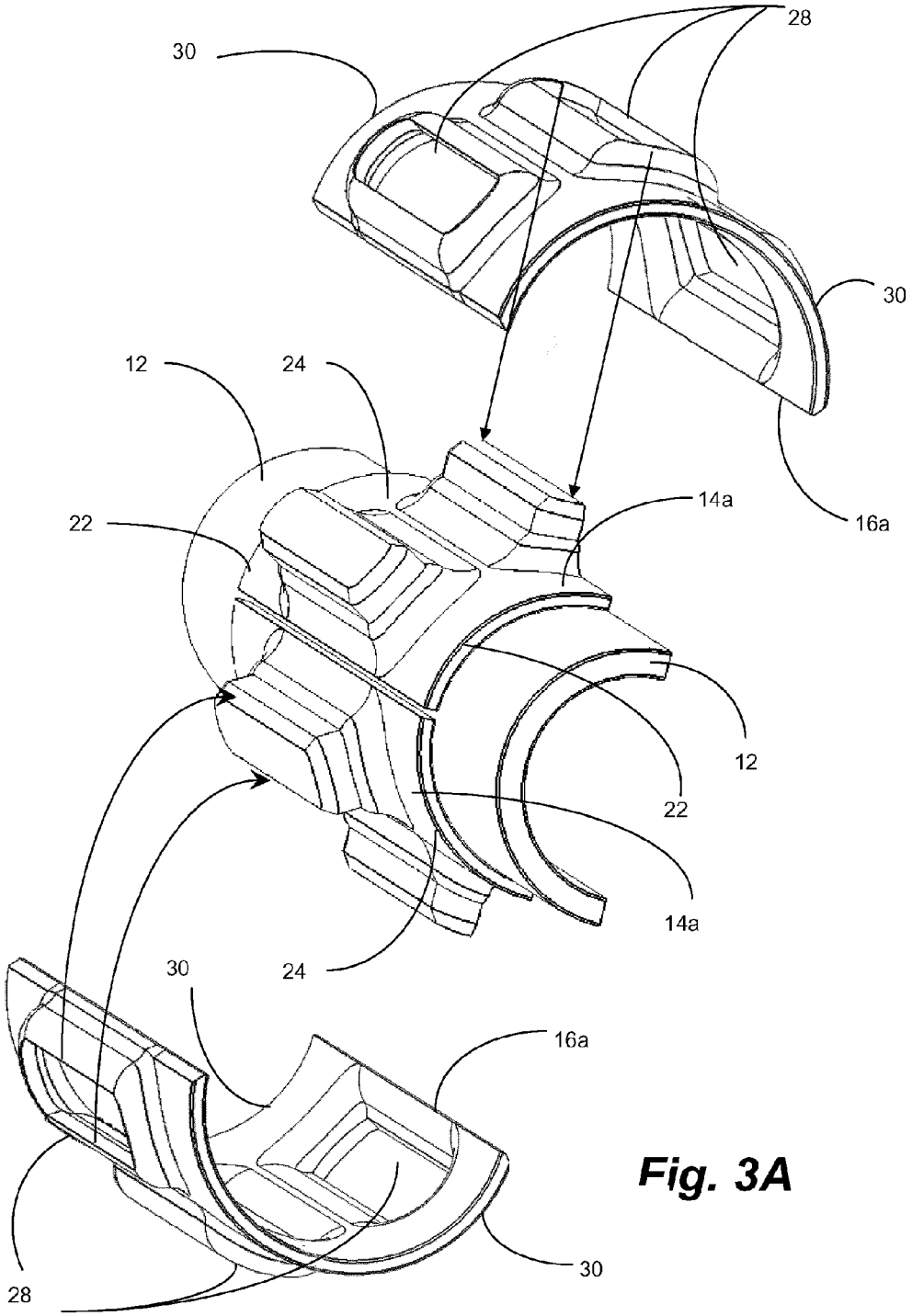
FIG. 3A is a perspective exploded view of two semi-circular support body segments each for installation over two inner sleeve segments of the centralizer of FIG. 1A, each inner sleeve segment having one and one-half protruding members.

With reference to FIG. 3A, the arrangement of FIGS. 2C and 2D is in relative location such as for assembly. In this arrangement it is likely that two inner sleeve segments 14*a*,14*a*, having one and one-half protruding members 20 per segment would need to be pre-installed into the three-window 28 support body segments 16*a*. A first semi-circular support body segment 16*a* is aligned with two 90 degrees inner sleeve segments 14*a*,14*a* (only one of two are shown in this section) and a second semi-circular support body segment 16*a* is aligned with another two 90 degrees inner sleeve segments 14*a*,14*a*.

Figure 3B:
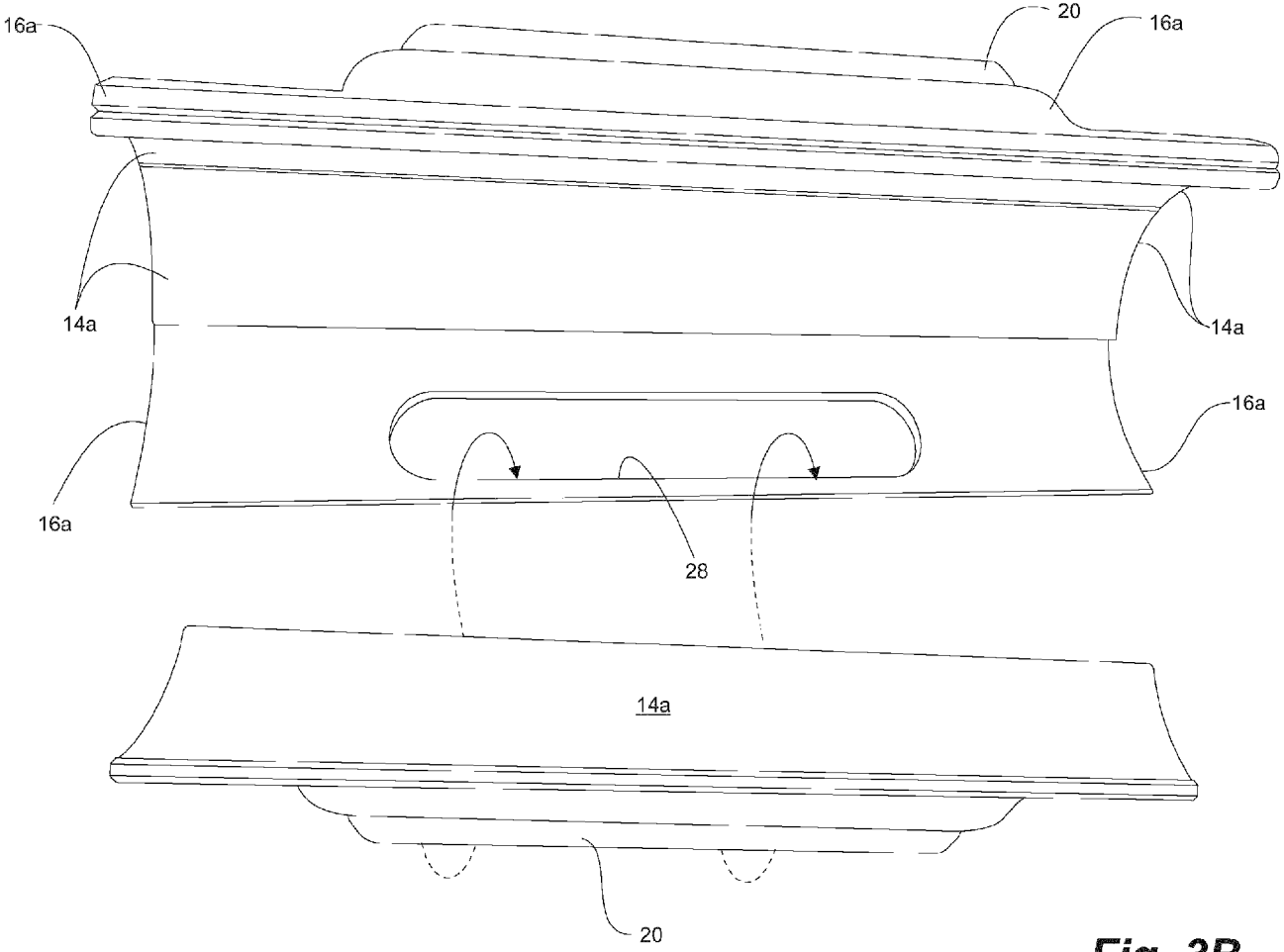
FIG. 3B is a perspective view of one semi-circular support body segment for three protruding members and having two inner sleeve segments fit thereto and one of the inner sleeve segments shown displaced or removed to the side to illustrate its corresponding remaining window in the support body segment.

With reference to FIG. 3B, one semi-circular support body segment 16*a* is preloaded with two of three inner sleeve segments 14*a*, the protruding members 20 extending through their respective windows 28. This embodiment is similar to that shown in FIGS. 2A and 2B. One inner sleeve segment 14*a* is shown displaced with installation arrows indicating its form of installation with the protruding member 20 extending into the remaining available window 28.

Figure 4:
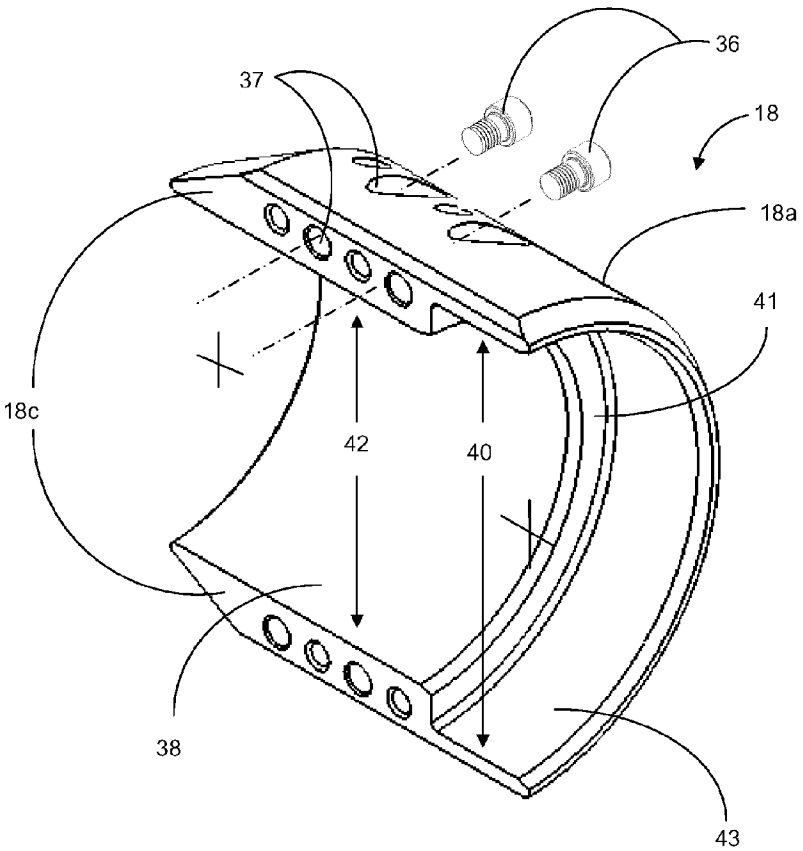
FIG. 4 is a perspective side cross-sectional view of an annular end collar of the centralizer of FIG. 1A.

Having reference to FIG. 4, each annular bookend end collar 18 is formed as two semi-circular clamshell segments or halves 18*a* and 18*b* which are connected together at connecting edges 18*c*. When coupled, the end caps 18,18 retain both the support body 16 and inner sleeve 14 to the and the tubular 12. The end caps are assembled using fasteners such as at least two high tensile steel bolts or cap screws 36, at opposing tangential connectors, spanning across the connecting edge 18*c*. This is similar to the connection arrangement discussed in the prior art. Generally, the fasteners 36 extend transverse to the longitudinal axis of the centralizer 10, each bolt 36 being installed in an opposing direction to a longitudinally adjacent fastener 36 through a corresponding bolt hole 37. As one of skill in the art will appreciate, the more fasteners 36 which can be used the stronger the connection. The number of fasteners 36 which can be used is generally limited by the axial length of the end collars 18 and practically, by the overall axial length of the support body 16.

Each end collar 18 comprises a collar bore 38 formed longitudinally or lengthwise therethrough. The bore 38 has a first diameter section 40 corresponding to a diameter of the ends 30,30 of the support body 16, and a second diameter section 42 corresponding to a diameter of the tubular 12. The step in diameter sections 40,42 forms a stop shoulder 41 and the first diameter section 40 forms an annular overlapping portion 43. The second diameter section is a clamping bore portion and is smaller than the first diameter section.

Figure 5:
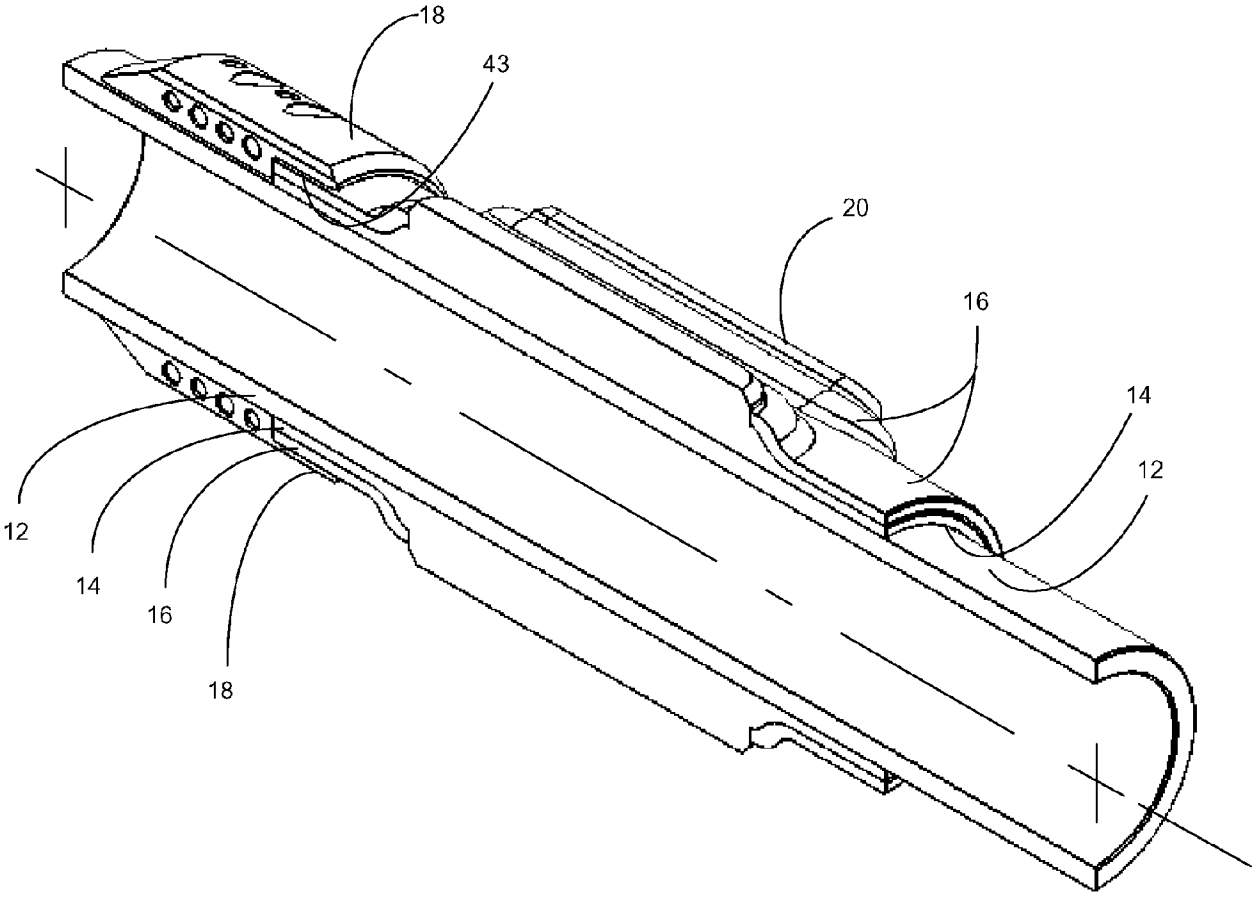
FIG. 5 is a perspective, longitudinal view of the centralizer of FIG. 1A, sectioned along the tubular axis, one semi-circular support body and one end collar removed for illustrating the inner sleeve, support body and end collar interfaces.
Figure 6:
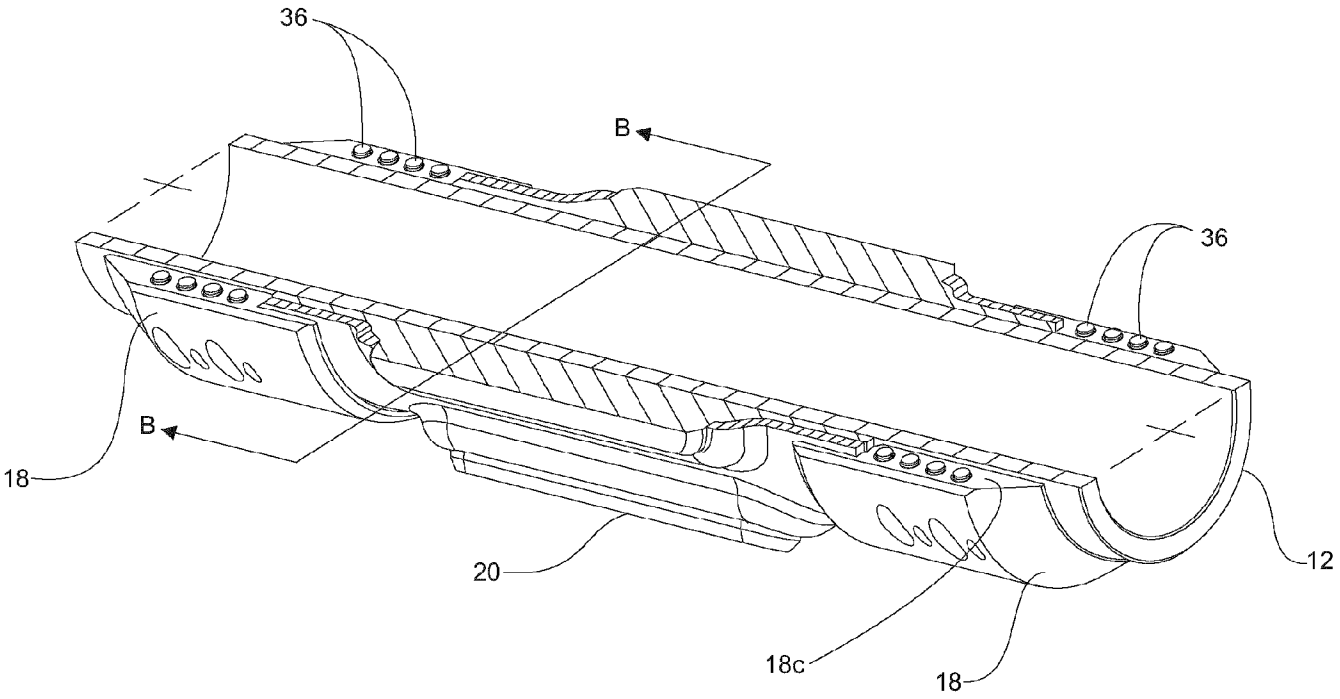
FIG. 6 is a perspective, longitudinal view of the centralizer of FIG. 1A, sectioned along the tubular axis.

Turning to FIGS. 5 and 6, the centralizer 10 is assembled around the tubular 12 as follows: the inner sleeve 14 is arranged circumferentially around the tubular 12 and the support body segments 16*a* are circumferentially arranged around the inner sleeve 14, the protruding members 20 being aligned and fit to the corresponding windows. The protruding members 20 are received within the windows 28 and project radially outwardly therethrough. The various components are held in place by the bookend end collars 18,18. As also shown in isolation in FIG. 7, the annular overlapping portions 43,43 of the end collars 18, 18 are axially located about the respective downhole and uphole ends 30,30 of the support body 16. As shown in this embodiment, and illustrated where the opposing end collar 18 has been omitted in FIG. 5 for viewing the ends 22,30, the inner sleeve's ends 22,22 happen to be coincident with the ends 30,30 of the support body 16.

Figure 7:
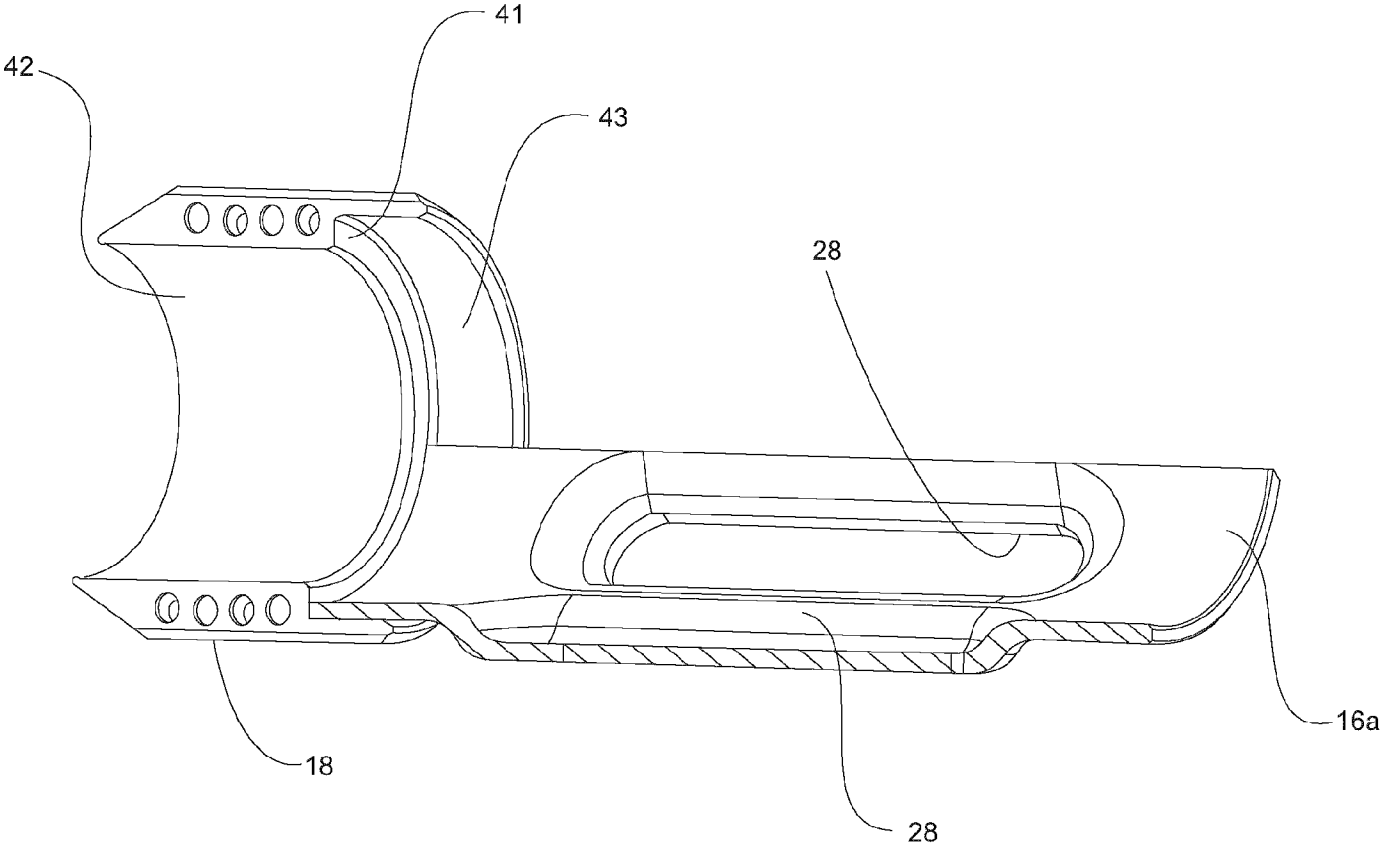
FIG. 7 is a perspective side cross-sectional view of one half of the end collar of FIG. 4 with one support body segment supported therein.
Figure 8A:
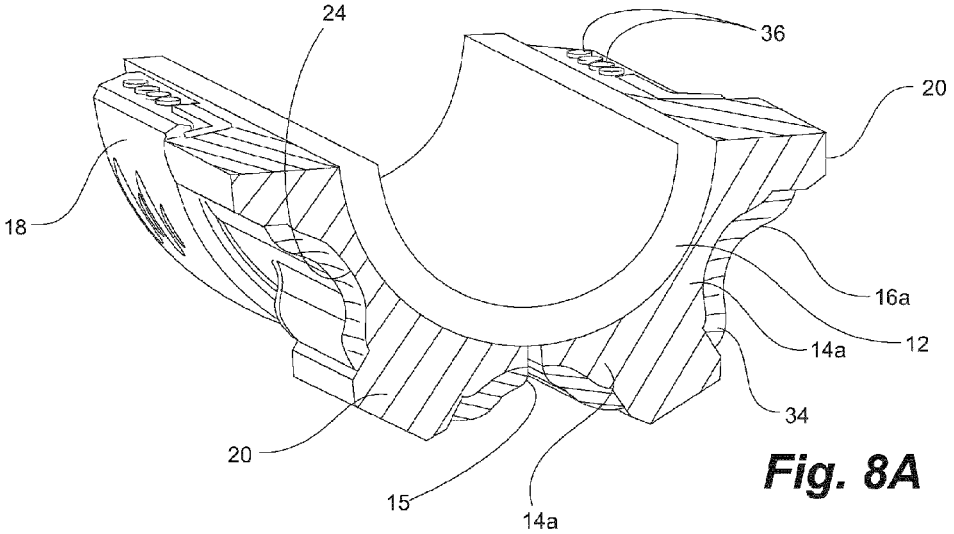
FIGS. 8A and 8B are cross-sectional views along line B-B of FIG. 6, more particularly.
Figure 8B:
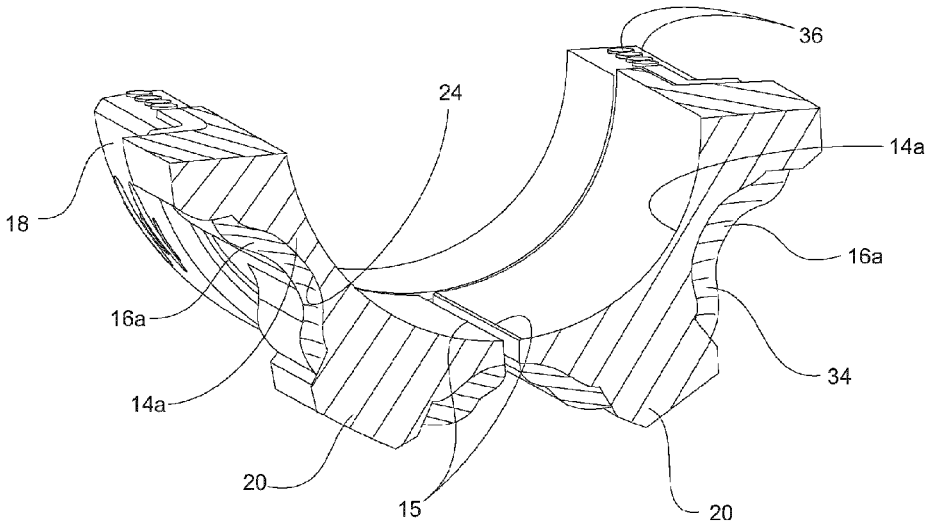

Also shown in FIGS. 7, 8A and 8B, when the second diameter portion or clamping bore 42 of the end collars 18 are secured to the tubular 12, the end collars 18,18 retain the support body 16 and the inner sleeve 14 about the tubular 12. The opposing ends 22, 22 and end portions 30, 30 of the inner sleeve 14 and the support body 16, respectively are received within the first diameter section 40 of the end collar 18, the annular overlapping portion 43 radially retaining the support body 16 against the inner sleeve 14 which is retained against the tubular 12. The ends 30,30 of the support body 16 abut the respective shoulders 41,41 for fixing the axial position of the inner sleeve 14 and support body 16. This enables the inner sleeve 14 and the support body 16 to be circumferentially supported around the tubular 12. The stop shoulders 41,41 also axially delimit the support body 16 against movement along the tubular 12. Depending on the clearances between the support body 16 and the end collar 16 and between the inner sleeve and tubular, the inner sleeve and support body could rotate about the tubular 12. The second diameter section 42 of the end collar 18 grips the tubular 12 for positioning and fixing the support body 16 and the inner sleeve 14 on the tubular 12.

In order to minimize interference or catching with casing collars and other discontinuities during installation and use, the leading and trailing longitudinal edges of all components can be chamfered including the end collars 18, the support body buttresses 34, and the protruding member 20.

Once assembled, the protruding members 20 on the inner sleeve extend beyond the support body 16 to a radial extent greater than that of the end collars 18, 18 for spacing the tubular 12, the support body 16 and the end collars 18, 18 from the walls of the casing or wellbore. This also minimizes contact between the support body 16 and the wellbore or casing sidewalls. Due to the unique construction of the inner sleeve 14 and the support body 16, no connectors are required to retain the inner sleeve 14 and the support body 16 together. Engagement of the protruding members 20 with the windows 28 retains the inner sleeve 14 within the support body 16. The only connectors required are associated with the end collars 18, 18 for retaining and positioning the inner sleeve 14 and the outer body 16 about the tubular 12. The unique construction of the annular end collars 18, 18 enables the end collars 18 to be secured about the support body 16 using minimal connectors. The configuration of the centralizer 10 is therefore less complicated, having minimized the number of connectors, therefore minimizing the risk of failure and reducing the cost and assembly time.

As the only contact between the centralizer 10 and casing or wellbore walls is the protruding members 20, the inner sleeve 14 is prone to wear and tear and is sacrificial. Multi-segment construction of the inner sleeve 14 enables replacement of only the inner sleeve segment 14*a* with worn protruding members. Only those individual inner sleeve segments 14*a* whose one or more protruding members 20 are worn sufficiently to warrant replacement are need be replaced at any one time however conservative practices may dictate replacing all at once. The method for replacement of inner sleeve segments 14*a* with worn protruding members 20 typically comprises disengaging at least one of the annular end collars 18 and removing one or more of the support body segments 16*a* for accessing the inner sleeve segments 14*a*. The inner sleeve segments with worn protruding members 20 are then removed and replaced with replacement inner sleeve segments. The replacement inner sleeve segments and the support body segments are then re-installed about the tubular and the disengaged annular end collar is secured to the tubular and about the opposing end portion of the support body.

The embodiments of the invention for which an exclusive property or privilege is claimed are defined as follows:

1. A centralizer for installing about a joint of tubular and having at least three protruding members extending therefrom for spacing the tubular from a wellbore, the centralizer comprising:

a resilient inner sleeve formed of two or more inner arcuate sleeve segments, the two or more inner sleeve segments adapted for arrangement in a radial array about the tubular and forming at least two longitudinal discontinuous joints along the inner sleeve, the inner sleeve segments forming opposing axial ends and a central bore adapted for slidably receiving the tubular;

a tubular outer support body formed of two or more arcuate segments for arrangement in a radial array about the inner sleeve segments and forming at least two longitudinal discontinuous joints along the support body, the support body segments forming opposing axial ends and a body central bore for receiving the inner sleeve; and a pair of annular end collars configured to secure to the tubular at opposing axial ends of the support body for preventing axial movement of the support body therebetween, each of the end collars having an annular overlap portion having a first diameter section for overlapping a portion of the respective axial ends of the at least two longitudinal discontinuous joints in the support body and the inner sleeve respectively, the annular overlap portion preventing outward radial movement of the two or more support body segments from about the tubular; and a clamping bore portion having a second diameter section for engaging the tubular, the second diameter section being smaller than the first diameter section and corresponding to a diameter of the tubular, wherein, when the pair of end collars are installed to the tubular, the axial ends of the at least two longitudinal discontinuous joints in the support body and the inner sleeve are received within the respective first diameter sections and the second diameter sections form stop shoulders therebetween and wherein the resilient inner sleeve forms the at least three protruding members extending therefrom.

2. The centralizer of claim 1, wherein each of the inner sleeve segments further comprises at least one protruding member extending radially outwardly from an outer surface thereof so as to form the at least three protruding members extending from the inner sleeve for spacing the tubular from the wellbore; and each of the support body segments further comprises at least one window formed therein through which one protruding member of the at least three protruding members extends when the inner sleeve is received in the body central bore.

3. The centralizer of claim 2 wherein the protruding members and the windows are formed generally longitudinal therealong.

4. The centralizer of claim 1 wherein the first diameter section receives both of the support body and the inner sleeve.

5. The centralizer of claim 1, wherein the support body is made of metal.

6. The centralizer of claim 1, wherein the inner sleeve is made of a polymer.

7. The centralizer of claim 1, wherein the inner sleeve is made of polyurethane.

8. The centralizer of claim 1, wherein the inner sleeve comprises three or more arcuate inner sleeve segments; and wherein the three or more inner sleeve segments are retained about the tubular by the two or more support body segments.

9. The centralizer of claim 1, wherein the inner sleeve comprises six arcuate inner sleeve segments spaced at about 60 degrees; and the support body comprises two semi-circular support body segments forming six windows; wherein the six inner sleeve segments are retained about the tubular by the two support body segments, and the two support body segments are retained about the inner sleeve by each of the end collars.

10. The centralizer of claim 1, wherein each of the end collars comprises two semi-circular clamshell segments and the two clamshell segments are clamped together about the support body using connectors across longitudinal connecting edges.

11. The centralizer of claim 1 wherein when the axial ends of the at least two longitudinal discontinuous joints in the support body and the inner sleeve are received within the respective first diameter sections, the inner sleeve and support body rotate about the tubular.

12. A method for removing and replacing worn components of a centralizer of claim 2 comprising:

disengaging at least one of the pair of end collars;

removing at least one of the two or more support body segments for accessing the two or more inner sleeve segments having one or more worn protruding members;

removing at least one of the inner sleeve segments with the one or more worn protruding members;

replacing each of the removed inner sleeve segments with a replacement inner sleeve segment with one or more protruding members extending through corresponding support body windows of the at least one removed support body segment; and re-installing the support body segments and replacement inner sleeve segments about the tubular; and securing the at least one of the pair of end collars about opposing end portions of the support body.

13. A method of installing a centralizer about a joint of tubular, locating a first annular end collar about the tubular and clamping a first bore portion thereof to a diameter of the tubular for forming a stepped annular bore between the tubular and a first overlapping portion of the first annular end collar;

arranging first axial ends of two or more arcuate segments of a resilient inner sleeve circumferentially about the tubular and fit axially within the stepped annular bore for radially retaining the two or more segments of the inner sleeve therein;

arranging first axial ends of two or more arcuate segments of an outer support body circumferentially about the tubular and within the stepped annular bore for radially retaining the two or more segments of the support body about the two or more segments of the inner sleeve and forming at least two discontinuous edges formed along the support body, all of which are radially retained to the tubular; and locating a second annular end collar over second axial ends of the at least two discontinuous edges formed along the support body for forming a stepped annular bore between the tubular and a second overlapping portion of the second annular end collar and clamping a first bore portion thereof to a diameter of the tubular for radially retaining the two or more support body segments and the two or more inner sleeve segments within the second end collar such that the inner sleeve and support body are slidably and rotatably retained about the tubular, the two or more inner sleeve segments forming at least three protruding centralizing members, wherein the first bore portion of the first and second annular end collars forms end stops for preventing axial movement of the support body and the inner sleeve along the tubular.

14. The method of claim 13, wherein each of the inner sleeve segments further comprises at least one protruding member extending radially outwardly from an outer surface thereof so as to form the at least three protruding members extending therefrom, and each of the support body segments further comprises at least one window formed therein for receiving one protruding member of the at least three protruding members; and wherein during arrangement of the two or more arcuate segments of the support body circumferentially about the tubular, extending the protruding member on the inner sleeve through a corresponding window in the support body.

15. The method of claim 13, wherein each of the inner sleeve segments further comprises at least one protruding member extending radially outwardly from an outer surface thereof so as to form the at least three protruding members extending therefrom, and each of the support body segments further comprises at least one window formed therein for receiving one protruding member of the at least three protruding members; and wherein prior to arrangement of the two or more inner sleeve segments within the first end collar, pre-installing each of the two or more inner sleeve segments into the two or more support body segments by extending the protruding member on the inner sleeve through a corresponding window in the support body.

* * * * *